US006320603B1

(12) United States Patent
Less

(10) Patent No.: US 6,320,603 B1
(45) Date of Patent: Nov. 20, 2001

(54) INA XEROGRAPHIC PRINTER, EQUALIZING WEAR ON THE PHOTORECEPTOR WITH A SUPPLEMENTAL EXPOSURE STEP

(75) Inventor: Krzysztof J. Less, London (GB)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/567,821

(22) Filed: May 9, 2000

(51) Int. Cl.[7] ..... B41J 2/385; G03G 13/04; G03G 21/00; G03G 21/06; G03G 21/08

(52) U.S. Cl. ..... 347/129; 347/118; 347/123; 347/130; 347/238; 399/128; 399/296

(58) Field of Search ..... 347/129, 130, 347/117, 118, 123, 232, 238; 399/296, 127, 128, 39, 177, 178, 194

(56) References Cited

U.S. PATENT DOCUMENTS 4,515,462 * 5/1985 Yoneda ..... 399/177 X
4,831,408 * 5/1989 Yoshikawa et al. ..... 347/118
4,887,102 * 12/1989 Yoshikawa et al. ..... 347/118
4,941,003 * 7/1990 Takeda et al. ..... 347/129
4,952,951 * 8/1990 Kumasaka et al. ..... 347/130
5,162,821 * 11/1992 Fukuchi et al. ..... 347/118
5,570,194 10/1996 Fukuchi et al. .
5,999,783 * 12/1999 Folkins ..... 399/296
6,047,155 * 4/2000 Pietrowski et al. ..... 399/296
6,075,959 * 6/2000 Jeyadev et al. ..... 399/127

FOREIGN PATENT DOCUMENTS 61-65274 * 4/1986 (JP) .

* cited by examiner

*Primary Examiner*—Susan S. Y. Lee
(74) *Attorney, Agent, or Firm*—R. Hutter

(57) ABSTRACT

A xerographic printer includes a rotatable photoreceptor which is exposed, with each cycle, by a regular exposure device to create an image desired to be printed. Elsewhere along the photoreceptor is disposed a supplemental discharge device which discharges only those small areas on the photoreceptor which were not discharged by the regular exposure device within the cycle. In this way, every small area of the photoreceptor is evenly discharged within each cycle, and thus every small area of the photoreceptor experiences the same amount of aging. The system is particularly useful for full-color xerographic printers, in which the photoreceptor is repeatedly discharged by different exposure devices within each cycle.

28 Claims, 2 Drawing Sheets

INA XEROGRAPHIC PRINTER, EQUALIZING WEAR ON THE PHOTORECEPTOR WITH A SUPPLEMENTAL EXPOSURE STEP

FIELD OF THE INVENTION

The present invention relates to the xerographic printing, then a particular relates it to provide a supplemental exposure step to the process in order to equalize wear on about photoreceptor surface.

BACKGROUND OF THE INVENTION

The basic steps of xerographic printing are well known. A charge retentive member, typically called a photoreceptor, is initially uniformly charged to a predetermined bias. In a subsequent exposure step, specific areas of the photoreceptor are selectably discharged according to an image desired to be printed. In it the case of an analog copier, focused light reflected from of the original image is used to expose the photoreceptor to copy the original image. In the case of a digital or laser printer, a modulating laser, scanning across a the moving photoreceptor, it is operated according to a digital image data, and on those small locations on the photoreceptor in which in the laser is on, the initial charge on the photoreceptor is discharged by the laser. Following of the exposure step, the imagewise-discharged photoreceptor it is developed by applying marking of particles, generally known as toner, to the photoreceptor. Typically, the of marking particles attached to the photoreceptor in that the charge areas thereof, which correspond to the print-black areas of the image it desired to be printed.

Following the developing step, the particles which are attached electrostatically to the photoreceptor are transferred, again by an electrostatic bias, into a print sheet, such as of paper. Finally, the paper with the transfer of marking particles there on a is fused, or heated, so that of the particles are permanently attached to the print sheet. (In the above discussion, the basic case of a monochrome xerographic printer or copier is described, but it will be apparent that the same principle will apply to the color xerography context as well.)

The present invention is directed to an improvement to the xerographic process, which addresses the problem of uneven wear experienced by a photoreceptor. Particularly in an office context, where numerous page images are output by a printer, all of the page images having a similar general set of margins, certain portions of the photoreceptor, particularly those corresponding to the side margins, will almost never be used for the printing of black portions of an image. In other words, because in that the office context the margin portions of an image will always be discharged by a laser or other exposure device, these portions of the photoreceptor will experience a different level of wear compared to those portions of the photoreceptor surface which are relatively less often discharged by the laser.

In certain contexts of xerographic printing, particularly in high volume situations where parts such as photoreceptors must be replaced on a regular basis, it is desirable to have the discharge of the entire surface of the photoreceptor evenly distributed, in order to optimize the use of the photoreceptor. The present invention is directed toward a method of operating a xerographic printer such that, in addition to the basic exposure step required for creation of the desired image on the photoreceptor, a supplementary exposure step is carried out, directed toward portions of the photoreceptor surface which were not exposed during of the standard exposure step.

Certain designs of photoreceptor are known to change their electrical characteristics depending on the total integrated exposure that any particular small area of the photoreceptor has received through its operational life. In other words, a portion of a photoreceptor surface of that is exposed fairly often will in effect age faster than another small area of the same photoreceptor which is exposed by the laser relatively less often. This unevenness in the aging of the photoreceptor surface can result in print quality defects, particularly in color printers, where a small changes in the development voltage associated with the photoreceptor and various stages in the printing process may result in an unacceptable variation in color reproduction.

DESCRIPTION OF THE PRIOR ART

U.S. Pat. No. 5,570,194 discloses a color xerographic printer in which successive primary color images are superimposed on a photoreceptor. According to the invention described in the reference, following the successive development of multiple primary color images, a further exposure step is carried out immediately before transfer of the color toner images. This additional exposure step is carried out only on the portions of the photoreceptor which have received toner thereon. The purpose of this pre transfer exposure step is to ensure uniform charging of the entire photoreceptor area prior to transfer. Significantly, in this reference, the pre transfer exposure is carried out only on toner-bearing areas of the photoreceptor.

SUMMARY OF THE INVENTION

According to the present invention, there is provided an electrostatographic printing apparatus, and method of operating thereof. The printing apparatus includes a charge receptor, the charge receptor being movable in a process direction through a plurality of cycles, and a first regular exposure device for creating an electrostatic latent image on the charge receptor in response to digital image data. A supplemental exposure device is provided, the supplemental exposure device discharging selectable small areas on the charge receptor. The supplemental exposure device is operated to discharge small areas on the charge receptor, which were not exposed by the first regular exposure device within a cycle.

DETAILED DESCRIPTION OF THE INVENTION

Figure 1:
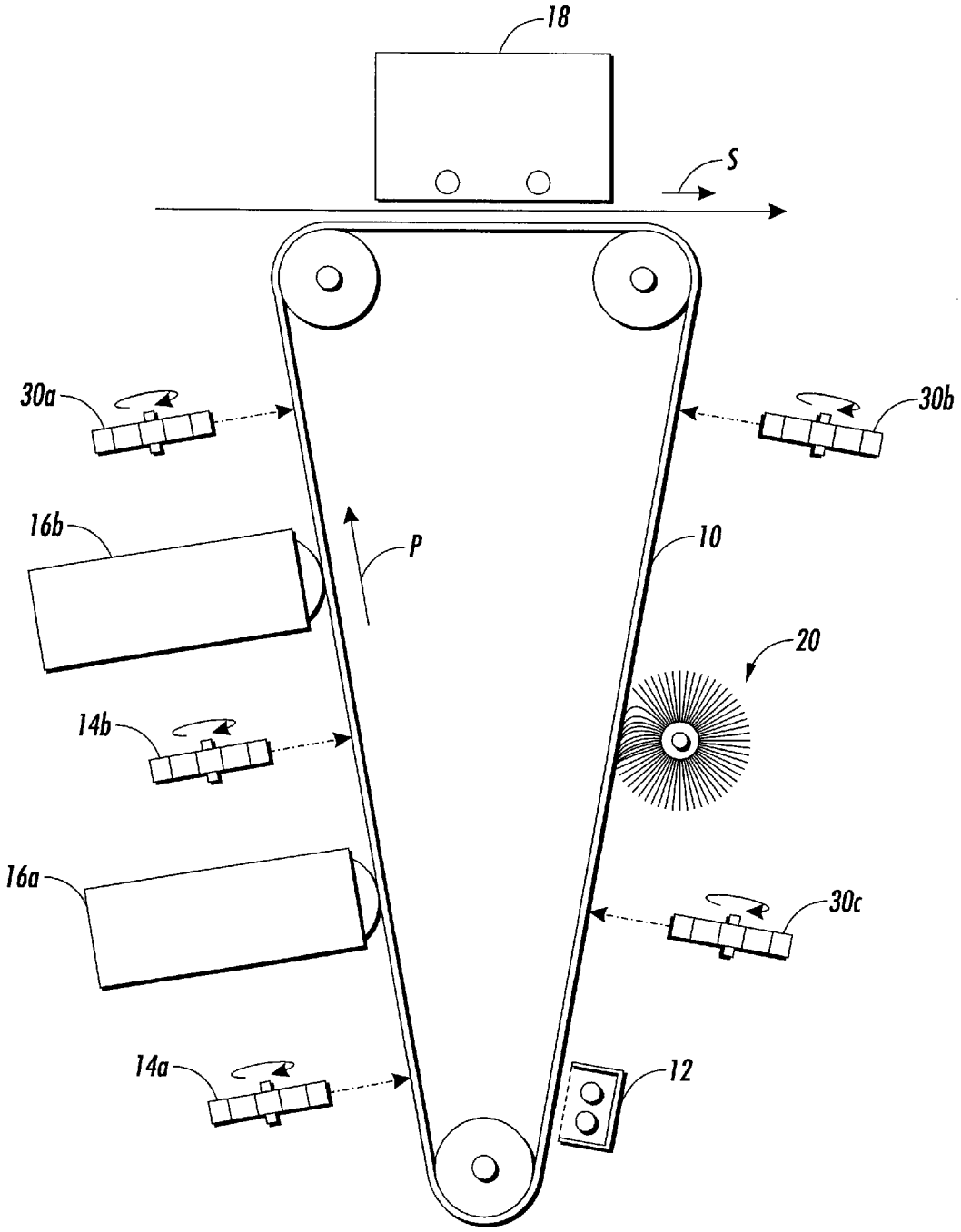
FIG. 1 is a simplified elevational showing he basic elements of a xerographic printer, including elements associated with the claimed invention.

FIG. 1 is a simplified elevational view of a xerographic print engine which incorporates the present invention. Shown in FIG. 1 are the standard elements of any xerographic printer. The photoreceptor 10 (or, more generally, a "charge receptor"), which in this case is in belt form, is entrained around a set of rollers. The photoreceptor belt 10 travels in a process direction P, and travels through repeated cycles, or rotations, as the printer is used to output a series of images. At one location around the photoreceptor belt and it is a charge device 12, which may be of any type known in the art. The charge device 12 creates a uniform bias across the photoreceptor surface. Immediately downstream of the charge device 12 is an exposure device 14*a*, followed by a development unit 16*a*. As is well known in the xerographic art, the exposure device 14*a* (in the claims herein, a "regular exposure device") selectively discharges small areas of the surface of photoreceptor 10 according to digital data relating to an image desired to be printed: typically but not necessarily, small areas which correspond to "print-white" portions of the image are discharged by the exposure device while "print-black" areas remain charged (in some designs this arrangement is reversed). This arrangement of charged and discharged areas is commonly known as an "electrostatic latent image." As shown in the Figure, exposure device 14*a* includes a rotating mirror which causes a laser beam to scan across the photoreceptor 10, but other types of exposure device, such as an LED bar or ionographic head, are imaginable in conjunction with the present invention. Following the exposure step, the electrostatic latent image on the photoreceptor 10 are developed by development unit 16*a*, according to one of any number of development methods known in the art.

Further shown in the Figure is another set of exposure and development devices, indicated as 14*b* and 16*b*. Such additional devices may be required in, for example, a color xerographic printer: indeed, in a full color printer there would typically be four or more such development units, which may include additional exposure devices, depending on a particular design.

Among the other elements shown in the Figure which are typically found in the standard design of a xerographic print engine are a transfer station 18, at which toner images are transferred from of the photoreceptor 10 to a sheet moving in direction S, and, downstream from transfer station 18, a cleaning device 20, which may be of any design known in the art. In the standard xerographic print engine there would further be a fuser station (not shown) for fusing toner images onto the sheet with heat and pressure.

With particular reference to the elements relevant to the present invention, there are shown in FIG. 1 a number of exposure devices disposed at various locations along the photoreceptor 10. These supplemental exposure devices are indicated as a 38*a*, 30*b*, and 30*c*. Although the figure shows three of such additional supplemental exposure devices, in a design of the president mentioned, it is probably required to have only one of the free supplemental exposure devices. However, for purposes of completeness, three such supplemental exposure devices are shown in various locations.

The purpose of any one of the supplemental exposure stations is to discharge any areas of the photoreceptor which were not already discharged by exposure devices such as 14*a* or 14*b* incidental to creating an image desired to be printed. Once again, a specific practical problem to be addressed by the present invention is the uneven aging of different parts of photoreceptor surface caused by exposure of the photoreceptor to a laser such as 14*a* or 14*b*. The exposure caused by the laser in an exposure device ages the particular small area of the photoreceptor, and changes the electrical properties associated with the small area. Repeated exposure of a particular small area of the photoreceptor can create a history of high aging in a particular small area, relative to another small area which is not exposed quite as often. Once again, this idea the aging of different small areas of the photoreceptor can result in noticeable print quality defects, simply because of the electrical properties of different small areas will result in the different toner behavior in the course of the xerographic process particularly in the development step. The purpose of the supplemental exposure device, whether located in the positions shown at 30*a*, 30*b*, or 30*c* in the Figure, is to compensate for the wear caused by the exposure of one or more imaging devices such as 14*a* or 14*b*.

In order to perform this compensation, a supplemental exposure device according to the present invention exposes, such as with a laser, other light emitting device, or an ion-emitting device, all of the small areas of the photoreceptor which were not exposed by a one or more exposure devices, such as 14*a* or 14*b*, incidental to creating the image it desired to be printed. Thus, in the basic case, if there is operated only one exposure device such as 14*a*, the supplemental exposure device, whether it be located in the position shown at 30*a*, 30*b*, or 30*c*, will expose all the areas on the photoreceptor which were not exposed by the laser at exposure device 14*a*. In effect, the supplemental exposure device is caused to expose on the photoreceptor surface an image which is the visual negative of the image exposed by the exposure device 14*a*: the supplemental exposure device will place an image on the photoreceptor which is print black wherever the actual image from exposure device 14*a* was print white, and vice versa.

Because the essential purpose of the supplemental exposure device of the present invention is to ensure that every small area along the length of the photoreceptor is eventually exposed with every cycle of the photoreceptor 10, the supplemental exposure device can be disposed at any number of places along the circumference of photoreceptor 10. Examples of such locations for the supplemental exposure device are given as locations and 30*a*, 30*b*, or 30*c*: once again, it is probably necessary to have only one of the supplemental exposure devices shown in the Figure. Depending on the particular design of a xerographic engine, the supplemental exposure can occur before transfer, such as at 30*a*, immediately after transfer such as that 30*b*, or following the cleaning step, such as at 30*c*.

Although the Figure shows the supplemental exposure devices as laser beams reflected from a rotating mirror, other types of exposure devices are certainly allowable, and it is not necessary that the supplemental exposure device be of the same type as the regular exposure device: in other words, if the regular exposure device 14*a* is a laser and rotating mirror, the supplemental exposure device could be an LED bar or ionographic head. Also, because the character of the supplemental exposure device is largely immaterial to short-term print quality, the design of the supplemental exposure device need not be very sophisticated. For example, the resolution of the negative image created by the supplemental exposure device need not have a particularly high resolution: whereas the regular exposure device such as 14*a* is typically of a resolution of 600 dpi, a supplemental exposure device can have a resolution of 100 dpi or less. What is important is that, on the whole, every small area across the width of the photoreceptor 10 receives generally the same amount of light or other discharging energy from either the regular exposure step or the supplemental exposure step with every, or even almost every, cycle of the photoreceptor 10.

As mentioned above, the supplemental exposure device, no matter where it is located along the photoreceptor 10, must expose the photoreceptor with light or other energy according to the visual "negative" of the energy used to discharge the photoreceptor to create the desired image to be printed. It follows that the data causing the supplemental exposure device to expose certain small areas of the photoreceptor must be tied to the actual image data used to create the image desired to be printed. In the basic case of a simple monochrome printer, such as having only one exposure device 14*a*, the supplemental exposure device will simply expose those small areas of the photoreceptor which were not exposed by the exposure device 14*a*. This can be done by a monitoring of the image data used to modulate exposure device 14*a*, logically inverting the data, and then delaying the data to compensate for the time delay taken for a small area of the photoreceptor to move from of the exposure device to the supplemental exposure device. In this way, any small area which was not exposed during their regular exposure will be exposed during supplemental exposure, and vice versa.

In the case of a xerographic printer in which a plurality of exposure devices for creating an image to be printed are disposed along the circumference of photoreceptor 10, the fact that different exposure devices will be exposing different small areas of the photoreceptor should be taken into account in deciding what small areas are to be exposed by the supplemental exposure device. For example, with regard to FIG. 1, some small areas of photoreceptor 10 will be exposed by exposure device 14*a*, and a possibly-partially-overlapping set of small areas may be exposed by exposure device 14*b*. In such a case, a supplemental exposure device such as 30*a*, 30*b*, or 30*c*, need only expose those small areas which were not exposed by any exposure device in the course of creating the complete (such as full-color) image. Once again, the key principle is that by the end of each cycle in which a complete image is printed, every small area across the width of the photoreceptor 10 is eventually exposed either by one exposure device or the supplemental exposure device.

Figure 2:
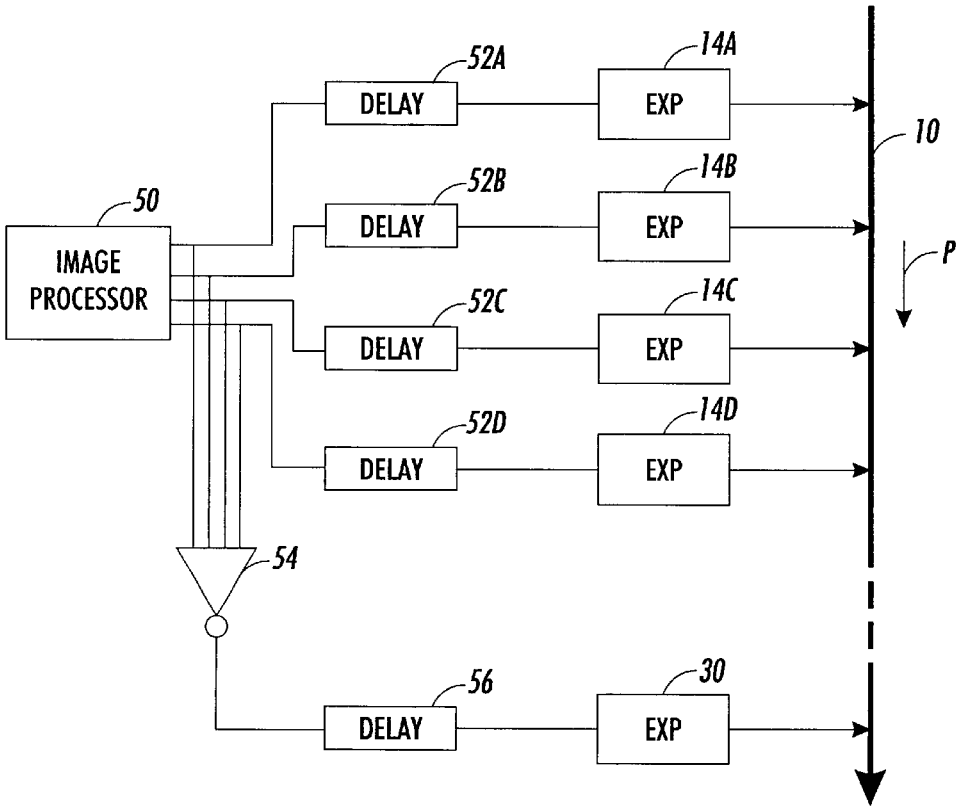
FIG. 2 is a simplified diagram showing the relationship of color images signals for placing primary color images on a photoreceptor, in combination with a supplemental exposure device according to the present invention.

FIG. 2 is a simple diagram showing how a supplementary exposure device, here indicated generally as 30, and any number of regular exposure devices, here indicated as 14*a–d*, can be coordinated to ensure that every small area associated with an image it is eventually exposed with each cycle. The digital data used to create the various color separation images for a full-color image to be superimposed, for example, the photoreceptor 10 is output from an image processor such as indicated as 50. The image processor 50 outputs image data used to modulate the different exposure devices corresponding to each primary color to be placed on the photoreceptor. As such, depending on the particular architecture of a color printer, the image data for placing each primary color images must be delayed by a somewhat predetermined amount to enable superimposition of the different primary color images into a single full color image. These various delays associated with the different exposure devices are shown generally as 52*a–d*.

As can be further seen in FIG. 2, the different inputs from image processor 50 to the various delays and exposure devices and logically combined, such as through a gate 54 or similar device, and sent to supplemental exposure device 30. But image input to supplemental exposure device 30 will of course have to be delayed as well, to some extent consistent with the specific location of the supplemental exposure device 30, so that the exposure created by a supplemental exposure device 30 is further superimposed on the full color image resulting from the superimposed primary color images from regular exposure devices 14*a–d*. Of course, because the function of the supplemental exposure device 30 is to expose any small areas within the particular image which were not exposed by any regular exposure device 14*a–d* in the course of creating the full color image, the supplemental exposure device 30 must be activated to discharge the small area wherever the photoreceptor was not previously exposed. Thus, in order to discharge a small areas complementary to the original image, the input to the supplemental exposure device 30 must be the logical inverse of the original image data. As such, gate 54 in the Figure shows not only an AND gate to logically combine the primary color image data, but also must invert the data, and as such is a NAND gate, in order to discharge any area that was not previously discharged. The output of NAND gate 54 is further delayed, such as by delay 56, to coordinate with the locations of image areas to be discharged by supplemental exposure device 30 as photoreceptor 10 moves.

Although the most basic logical relationship between of the image data and the data sent to the supplemental exposure device 30 is shown as a simple set of delays and a single gate, it will be apparent to a person of skill in the art creating a practical system that more sophisticated considerations must be taken into account. For instance, if the regular exposure devices 14*a–d* are of a relatively high a resolution and of the supplemental exposure device 30 is of a relatively low resolution, this resolution conversion must be taken into account.

In the above examples, it is assumed that any particular small area of the photoreceptor 10 is completely discharged by either a regular exposure device such as 14*a* or by supplemental exposure device 30. However, in more sophisticated xerographic systems, it may be possible that a regular exposure device may discharge small area by less than a complete extent, such as discharging the small area only half as much as the total amount of charge associated with the small area initially. Further, in a system with multiple regular exposure devices which may successively discharge the same small area multiple times, such as to superimpose primary colors, any small area of the photoreceptor may be a discharged by the various regular exposure devices to any of a wide range of extents. In a sophisticated version of present invention, the supplemental exposure device could take into account the fact that a particular small area of the photoreceptor has been discharged by multiple exposure devices, and then select an amount of energy required to finally discharge the small area based on how many times and to what extent the small area has been already discharged. For example, if it could be determined, based on the image data and a knowledge of the particular printer design, that a small area of the photoreceptor which has been discharged once by a regular exposure device 14*a* is discharged 50%, and a small area which has been discharged by two or more regular exposure devices such as 14*a* and 14*b* is discharged 75%, the image data for the supplemental exposure device 30 can be used to determine whether the supplemental exposure device 30 will discharge the small area by 100%, 50%, or 25%, in order to ensure a complete, or at least relatively even, discharge for the small area. Once again, the overall desired state is that every small area of the photoreceptor be roughly equally discharged with every cycle of the photoreceptor.

A system according to the present invention can further be provided to address situations in which the shape or size of sheets of being printed on must be taken into account. For example, in a standard letter-size-capable printer or copier, it may be occasionally desired to print out on small sheets, such as envelopes or index cards. In such a case, only a relatively small portion of the total area of the photoreceptor will be exposed for image purposes, and there will be a relatively large balance of non-image areas within each letter-sized image pitch. According to an embodiment of the present invention, this extra surface area on the photoreceptor can be exposed by a supplemental exposure device, once again to ensure that the entire effective surface of the photoreceptor is exposed with each cycle of the photoreceptor.

What is claimed is:

1. A method of operating an electrostatographic printing apparatus, the printing apparatus having a charge receptor, the charge receptor being movable in a process direction through a plurality of cycles, and a first regular exposure device for creating an electrostatic latent image on the charge receptor in response to digital image data, comprising the steps of:

providing a supplemental exposure device, the supplemental exposure device discharging selectable small areas on the charge receptor; and operating the supplemental exposure device to discharge small areas on the charge receptor which were not exposed by the first regular exposure device in a cycle, and not to discharge small areas on the charge receptor which were exposed by the first regular exposure device in a cycle, thereby substantially evenly discharging all small areas on the charge receptor during a cycle.

2. The method of claim 1, wherein the supplemental exposure device includes means for directing a laser to the charge receptor.

3. The method of claim 1, wherein the supplemental exposure device includes an LED bar.

4. The method of claim 1, wherein the supplemental exposure device includes an ionographic head.

5. The method of claim 1, the apparatus further including a transfer device, and wherein the supplemental exposure device is disposed along the process direction of the charge receptor between the first regular exposure device and the transfer device.

6. The method of claim 1, the apparatus further including a transfer device, and wherein the supplemental exposure device is downstream of the transfer device along the process direction.

7. The method of claim 1, the apparatus further including a cleaning device, and wherein the supplemental exposure device is disposed downstream of the cleaning device along the process direction.

8. A method of operating an electrostatographic printing apparatus, the printing apparatus having a charge receptor, the charge receptor being movable in a process direction through a plurality of cycles, and a first regular exposure device and a second regular exposure device for creating an electrostatic latent image on the charge receptor in response to digital image data, comprising the steps of:

providing a supplemental exposure device, the supplemental exposure device discharging selectable small areas on the charge receptor;

operating the supplemental exposure device to discharge small areas on the charge receptor which were not exposed by the first regular exposure device in a cycle; and operating the supplemental exposure device to discharge small areas on the charge receptor which were not discharged by either the first regular exposure device or the second regular exposure device in a cycle of the charge receptor.

9. A method of operating an electrostatographic printing apparatus, the printing apparatus having a charge receptor, the charge receptor being movable in a process direction through a plurality of cycles, and a first regular exposure device and a second regular exposure device for creating an electrostatic latent image on the charge receptor in response to digital image data, comprising the steps of:

providing a supplemental exposure device, the supplemental exposure device discharging selectable small areas on the charge receptor;

operating the supplemental exposure device to discharge small areas on the charge receptor which were not exposed by the first regular exposure device in a cycle;

for a small area on the charge receptor, within a cycle of the charge receptor, determining an extent of discharge experienced by the small area in a cycle of the charge receptor as a result of possible discharge from the first regular exposure device and the second regular exposure device, and operating the supplemental exposure device to discharge the small area to a predetermined extent based on the determined extent of discharge experienced by the small area within the cycle.

10. The method of claim 1, wherein the regular exposure device creates an electrostatic latent image at a first resolution and the supplemental exposure device discharges small areas on the charge receptor at a second resolution different from the first resolution.

11. An electrostatographic printing apparatus, comprising:

a charge receptor, rotatable in a process direction through a plurality of cycles;

a first regular exposure device, for creating a first electrostatic latent image on the charge receptor in response to a digital image data; and a supplemental exposure device for discharging small areas on the charge receptor which were not discharged by the first regular exposure device within a cycle of the charge receptor, and not discharging small areas on the charge receptor which were discharged by the first regular exposure device within the cycle.

12. The apparatus of claim 11, wherein the supplemental exposure device includes means for directing a laser to the charge receptor.

13. The apparatus of claim 11, wherein the supplemental exposure device includes an LED bar.

14. The apparatus of claim 11, wherein the supplemental exposure device includes an ionographic head.

15. The apparatus of claim 11, further including a transfer device, and wherein the supplemental exposure device is disposed along the process direction of the charge receptor between the first regular exposure device and the transfer device.

16. The apparatus of claim 11, further including a transfer device, and wherein the supplemental exposure device is disposed downstream of the transfer device along the process direction.

17. The apparatus of claim 11, the apparatus further including a cleaning device, and wherein the supplemental exposure device is disposed downstream of the cleaning device along the process direction.

18. An electrostatographic printing apparatus, comprising:

a charge receptor, rotatable in a process direction through a plurality of cycles;

a first regular exposure device, for creating a first electrostatic latent image on the charge receptor in response to a digital image data;

a supplemental exposure device for discharging small areas on the charge receptor which were not discharged by the first regular exposure device within a cycle of the charge receptor;

a second regular exposure device, the second regular exposure device creating a second electrostatic latent image on the charge receptor; and means for operating the supplemental exposure device to discharge small areas on the charge receptor which were not discharged by either the first regular exposure device or the second regular exposure device in a cycle of the charge receptor.

19. An electrostatographic printing apparatus, comprising:

a charge receptor, rotatable in a process direction through a plurality of cycles;

a first regular exposure device, for creating a first electrostatic latent image on the charge receptor in response to a digital image data;

a supplemental exposure device for discharging small areas on the charge receptor which were not discharged by the first regular exposure device within a cycle of the charge receptor;

a second regular exposure device, the second regular exposure device creating a second electrostatic latent image on the charge receptor;

means for determining, for a small area on the charge receptor, within a cycle of the charge receptor, an extent of discharge experienced by the small area in a cycle of the charge receptor as a result of possible discharge from the first regular exposure device and the second regular exposure device; and means for operating the supplemental exposure device to discharge the small area to a predetermined extent based on the determined extent of discharge experienced by the small area within the cycle.

20. The apparatus of claim 11, wherein the regular exposure device creates an electrostatic latent image at a first resolution and the supplemental exposure device discharges small areas on the charge receptor at a second resolution different from the first resolution.

21. An electrostatographic printing apparatus, comprising:

a charge receptor, rotatable in a process direction through a plurality of cycles;

a plurality of regular exposure devices, for creating a plurality of electrostatic latent images on the charge receptor in response to a digital image data; and a supplemental exposure device for discharging small areas on the charge receptor which were not discharged by any of the regular exposure devices within a cycle of the charge receptor, and not discharging small areas on the charge receptor which were discharged by any of the regular exposure devices within the cycle.

22. The apparatus of claim 21, wherein the supplemental exposure device includes means for directing a laser to the charge receptor.

23. The apparatus of claim 21, wherein the supplemental exposure device includes an LED bar.

24. The apparatus of claim 21, wherein the supplemental exposure device includes an ionographic head.

25. The apparatus of claim 21, further including a transfer device, and wherein the supplemental exposure device is disposed along the process direction of the charge receptor between the first regular exposure device and the transfer device.

26. The apparatus of claim 21, further including a transfer device, and wherein the supplemental exposure device is disposed downstream of the transfer device along the process direction.

27. The apparatus of claim 21, the apparatus further including a cleaning device, and wherein the supplemental exposure device is disposed downstream of the cleaning device along the process direction.

28. The apparatus of claim 21, wherein the regular exposure devices create an electrostatic latent image at a first resolution and the supplemental exposure device discharges small areas on the charge receptor at a second resolution different from the first resolution.

* * * * *